US006785508B2

(12) United States Patent
Jeong

(10) Patent No.: US 6,785,508 B2
(45) Date of Patent: Aug. 31, 2004

(54) DUPLEX PRINTING APPARATUS

(75) Inventor: Heung-sup Jeong, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/387,858

(22) Filed: Mar. 14, 2003

(65) Prior Publication Data

US 2003/0185610 A1 Oct. 2, 2003

(30) Foreign Application Priority Data

Apr. 2, 2002 (KR) ..... 2002-17905

(51) Int. Cl.[7] ..... G03G 15/00
(52) U.S. Cl. ..... 399/401; 399/124
(58) Field of Search ..... 399/110, 107, 399/401, 124, 388; 271/902

(56) References Cited

U.S. PATENT DOCUMENTS 6,621,997 B2 * 9/2003 Chung ..... 399/401 X
2002/0061215 A1 * 5/2002 Kamei ..... 399/401
2002/0114634 A1 * 8/2002 Ahn et al. ..... 399/401 X
2002/0118989 A1 * 8/2002 Tokutake et al. ..... 399/401
2003/0175059 A1 * 9/2003 Su ..... 399/364

FOREIGN PATENT DOCUMENTS

JP 04-140763 * 5/1992
JP 08-048449 * 2/1996

* cited by examiner

*Primary Examiner*—Sophia S. Chen
(74) *Attorney, Agent, or Firm*—Staas & Halsey LLP

(57) ABSTRACT

A duplex printing apparatus having a developing unit forming an image onto paper being conveyed, a settling unit fixing the image on the paper, a discharging roller selectively conveying the paper with the fixed image in an alternate direction, includes a feed frame disposed such that a front side faces the developing unit to guide the conveyance of the paper being picked up, a back plate disposed on a rear side of the feed frame to guide the paper reversed from the discharging unit for a duplex printing operation, a duplex unit guiding the paper to between the rear side of the feed frame and the back plate, and a feeding roller module having a feeding roller disposed on a lower portion of the feed frame to convey both the paper fed for a single-side printing operation and the reversed paper for the duplex printing operation.

37 Claims, 3 Drawing Sheets

DUPLEX PRINTING APPARATUS

CROSS-REFERENCE TO RELATED APPLICATIONS

This application claims the benefit of Korean Patent Application No. 2002-17905, filed Apr. 2, 2002, in the Korean Industrial Property Office, the disclosure of which is incorporated herein by reference.

BACKGROUND OF THE INVENTION

1. Field of the Invention

The present invention relates to a duplex printing apparatus, and more particularly, to a duplex printing apparatus with a reduced duplex printing path and a reduced occurrence of a paper jam.

2. Description of the Related Art

FIG. 1 is a cross-sectional view schematically showing a conventional duplex printing apparatus.

Referring to FIG. 1, a pickup roller 11 is rotated to pick up a paper sheet 13 from a stack of paper in a paper cassette 12. The picked up paper sheet 13 is passed through a returning guide 14 and conveyed to a developing unit 15. As the paper sheet 13 is passed through the developing unit 15, an image is developed on the paper sheet 13. Then the paper sheet 13 is passed through a settling unit 16 where the image is settled (fixed) under high temperature and pressure. The paper sheet 13 is then passed through registration rollers 17 to rotate a second returning guide 18 forward. Accordingly, the paper sheet 13 is passed through a discharge roller 19 and discharged out.

During a duplex printing operation, when an end of the paper 13 is passed through the second returning guide 18, a paper sensor (not shown) detects the end of the paper 13. Accordingly, a controller (not shown) rotates the discharge roller 19 in an alternative direction (a forward direction or a reverse direction) a predetermined time after the detection of the end of the paper 13, thereby reversing a conveying direction of the paper 13 before the end of the paper 13 is completely passed through the discharge roller 19. Accordingly, the paper 13 is passed through a rear side of the second returning guide 18 and transferred to a returned paper conveying path 20 that includes the returning roller 21, and then fed back to the returning guide 14 for the duplex printing operation.

In the construction described above, a problem occurs when a paper passing path for the duplex printing operation is relatively long, and when a duplex printing time is lengthened.

Moreover, as the paper passing path is lengthened, components like paper registration rollers and paper guides are additionally required, and the number of the components increases. As a result, the possibility of occurrence of a paper jam also increases.

Furthermore, as the paper passing path is lengthened, a size of the printing apparatus becomes large.

Also, for the duplex printing operation, a user usually purchases another separate duplex printing unit as an option to mount the duplex printing unit at a side of the printing apparatus. This again causes problems of an unnecessarily lengthened paper passing path, in addition to an inconvenience for the user to purchase and mount the separate duplex printing unit.

SUMMARY OF THE INVENTION

Accordingly, it is an aspect of the present invention to provide a duplex printing apparatus having an improved structure that has a reduced paper conveying path and requires a simpler structure.

Additional aspects and advantages of the invention will be set forth in part in the description which follows and, in part, will be obvious from the description, or may be learned by practice of the invention.

In order to accomplish the above and/or other aspects of the invention, a duplex printing apparatus according to an embodiment of the present invention includes a developing unit forming an image onto paper being conveyed, a settling unit pressing (fixing) the image on the paper, a discharging roller selectively conveying the paper with the image settled thereon in an alternate direction, a feed frame disposed such that a front side faces the developing unit to guide the conveyance of the paper being picked up, a back plate disposed on a rear side of the feed frame to guide the paper reversed from the discharging unit for the duplex printing operation, a duplex unit guiding the paper, which is passed through the settling unit and reversed from the discharging unit between the rear side of the feed frame and the back plate, and a feeding roller module comprising a feeding roller disposed on a lower portion of the feed frame to convey both the paper fed for a single-side printing operation and the reversed paper for the duplex printing operation toward the developing unit, and a plurality of paper feeding paths for guiding the paper therealong to the feeding roller.

The plurality of paper feeding paths include first and second paper feeding paths for guiding the paper fed from a plurality of built-in paper cassettes to the feeding roller, a third paper feeding path for guiding the paper reversed between the back plate and the feed frame to the feeding roller, and a fourth paper feeding path for guiding the paper fed from an external paper cassette to the feeding roller.

The fourth paper feeding path is formed between the first and the second paper feeding paths and the third paper feeding path.

The feeding roller module further includes a first registration roller unit disposed in contact with the feeding roller to convey the paper fed through the first and the second paper feeding paths, and a second registration roller unit formed between the first and the second paper feeding paths and the fourth paper feeding path to convey the paper fed through the third and the fourth paper feeding paths between the first registration roller unit and the feeding roller.

The first, the second, the third and the fourth paper feeding paths are disposed around the feeding roller and are formed by a plurality of guiding members that are disposed on a side bracket supporting the feed frame.

The feeding roller module includes a main gear coaxially disposed with respect to the feeding roller to rotate the feeding roller, and the main gear and each of a first and second power transmission gears mesh to transmit a power to a reverse feeding registration roller guiding the paper for a duplex driving operation and to a pickup roller picking up the paper from the external paper cassette, respectively.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
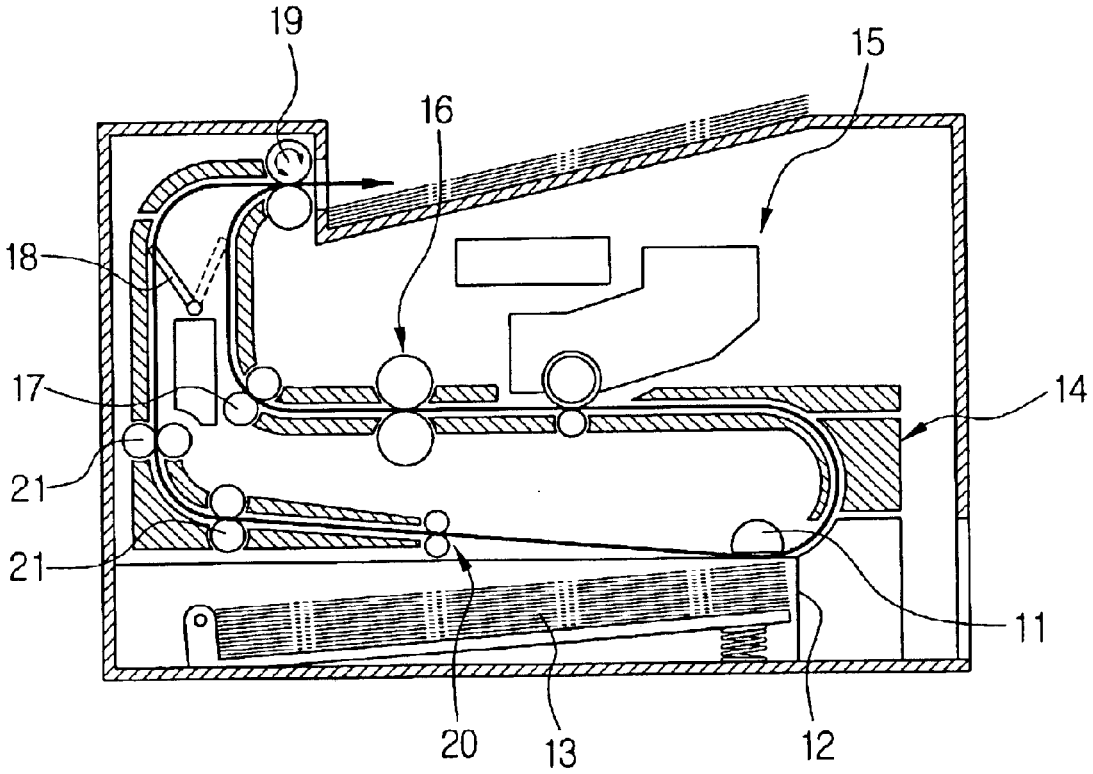
FIG. 1 (PRIOR ART)
FIG. 1 is a cross-sectional view schematically showing a conventional duplex printing apparatus.

Reference will now be made in detail to the present preferred embodiments of the present invention, examples of which are illustrated in the accompanying drawings, wherein like reference numerals refer to the like elements throughout. The embodiments are described below in order to explain the present invention to referring to the figures.

The present invention will be described in greater detail with reference to the accompanying drawings.

Figure 2:
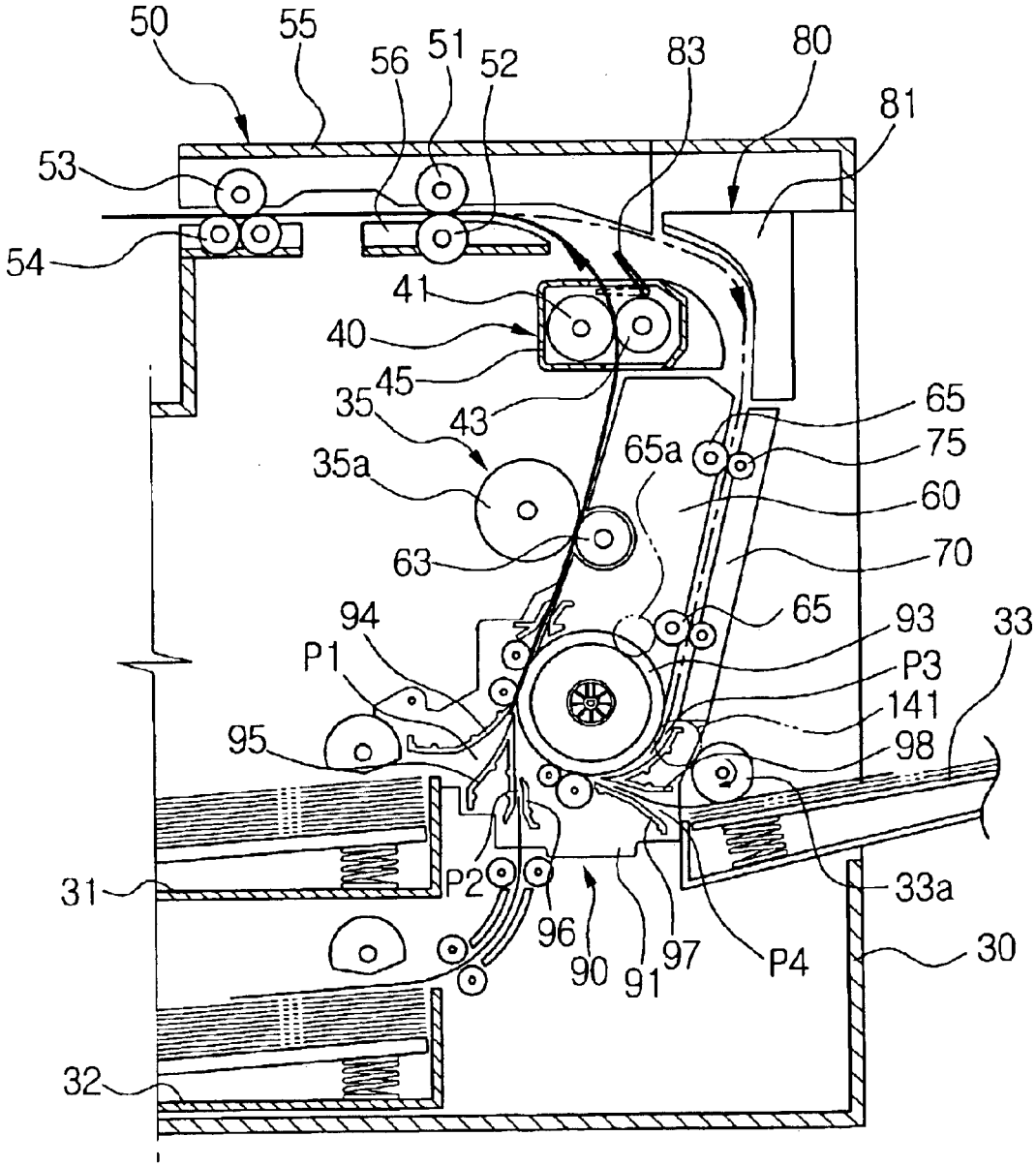
FIG. 2 is a schematic view showing a duplex printing apparatus according to an embodiment of the present invention.

Referring to FIG. 2, a duplex printing apparatus according to an embodiment of the present invention includes a printer body 30 in which a plurality of paper cassettes 31, 32 are mounted, a developing unit 35 forming an image on paper picked up and conveyed from the paper cassettes 31, 32, a setting unit 40, a discharging unit 50 discharging the printed paper outside the printer body 30, a feed frame 60, a back plate 70, a duplex unit 80 and a feeding roller module 90.

The paper cassettes 31, 32 are disposed on respective ones of a plurality of steps (positions) in the printer body 30 to accommodate the paper having one of various sizes.

For an external supply of the paper, a removable paper cassette 33 is also connected to a side of the printer body 30. The removable paper cassette 33 is pivotally connected to the side of the printer body 30, and a pick-up roller 33*a* picks up the paper from the removable paper cassette 33.

The developing unit 35 is disposed in a printing path and includes a photosensitive drum 35*a* and develops the image onto the conveyed (picked-up) paper. The construction of the developing unit 35 is well-known, and accordingly, the description thereof will be omitted. The paper conveyed to the developing unit 35 is then passed between the photosensitive drum 35*a* and a transfer roller 63. The transfer roller 63 is rotatably disposed on the feed frame 60.

The settling unit 40 is disposed in the printing path above the developing unit 35 to press and thus settle (fix) the image on the paper that has been passed through the developing unit 35. As is well-known, the settling unit 40 includes a pressure roller 41 and a backup roller 43. The backup roller 43 and the pressure roller 41 are rotatably disposed in a housing 45.

The discharge unit 50 is formed in a discharge path of the paper that has been passed through the settling unit 35. The discharge unit 50 includes a first discharge roller 51 and a second discharge roller 53. The first and second discharge rollers 51, 53 are spaced-apart by a predetermined distance from each other and are rotatable in an alternate direction (a forward direction or a reverse direction) by a proper driving source. Idle rollers 52, 54 are rotated while being in contact with the discharge rollers 51, 53, respectively. The first and the second discharge rollers 51, 53 are formed on an upper bracket 55 while the idle rollers 52, 54 are formed on a lower bracket 56. The respective upper and lower brackets 55, 56 guide the conveyance of the paper that is discharged/reversed.

Accordingly, for a duplex printing operation, the discharge rollers 51, 53 are reverse-rotated to return the paper to the developing unit 35 through a reverse feeding path (duplex printing path) before a trailing end of the paper, which has been passed through the settling unit 40, is completely passed through the first discharge roller 51.

The feed frame 60 is disposed opposite to the developing unit 35 and between the printing path and the reverse feeding path to guide either the picked-up paper or the reversed paper for the duplex printing operation. On a front side of the feed frame 60, the transfer roller 63 is disposed to rotate while being in contact with the photosensitive drum 35*a*.

On a rear side of the feed frame 60, the back plate 70 is disposed. The back plate 70 guides the paper reversed from the discharge unit 50 for the duplex printing operation. More specifically, the reversed paper is passed between the back plate 70 and the rear side of the feed frame 60. The back plate 70 can be connected to the rear side of the feed frame 60 by a proper fastener like screws. In order to convey the reversed paper, a reversing roller 65 and a reverse feeding registration roller 75 are formed at the feed frame 60 and the back plate 70, respectively.

The duplex unit 80 guides the paper, which has been passed through the settling unit 40 and reversed from the discharging unit 50, to be fed between the feed frame 60 and the back plate 70. The duplex unit 80 includes a guide frame 81 formed on an upper portion of the feed frame 60 to be disposed opposite to the settling unit 40 at a predetermined distance, and a pivoting lever 83 pivotally disposed on the settling unit 40. The guide frame 81 is disposed opposite to the housing 45 of the settling unit 40 at a predetermined distance.

The pivoting lever 83 pivots upward by the paper that is passed through the settling unit 40. After the paper is completely passed, the pivoting lever 83 is returned to its original position by weight. Accordingly, the paper reversed from the discharging unit 50 is guided by the pivoting lever 83 to be fed between the settling unit 40 and the guide frame 81. The pivoting lever 83 is connected to a sensor (not shown) that detects whether the paper has been passed through the settling unit 40. With a detected paper passing time being set as a reference, the first and the second discharging rollers 51, 53 are reverse-rotated a predetermined time after the paper passing time, to return the paper to the developing unit 35 at a proper time.

Figure 3:
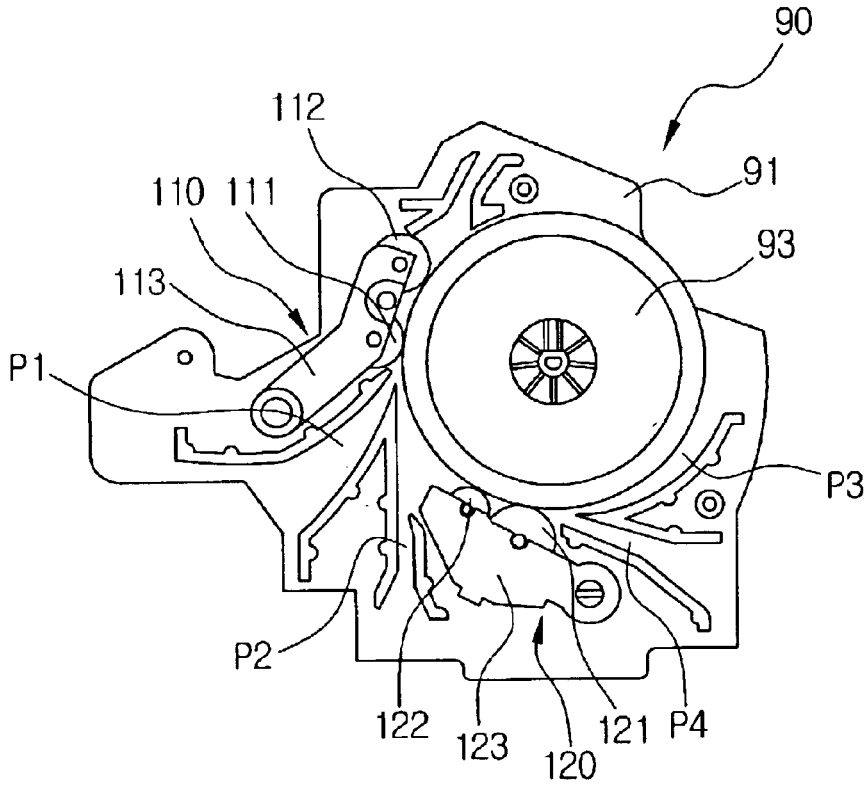
FIG. 3 is a cross-sectional view showing a feeding roller module of FIG. 2.
Figure 4:
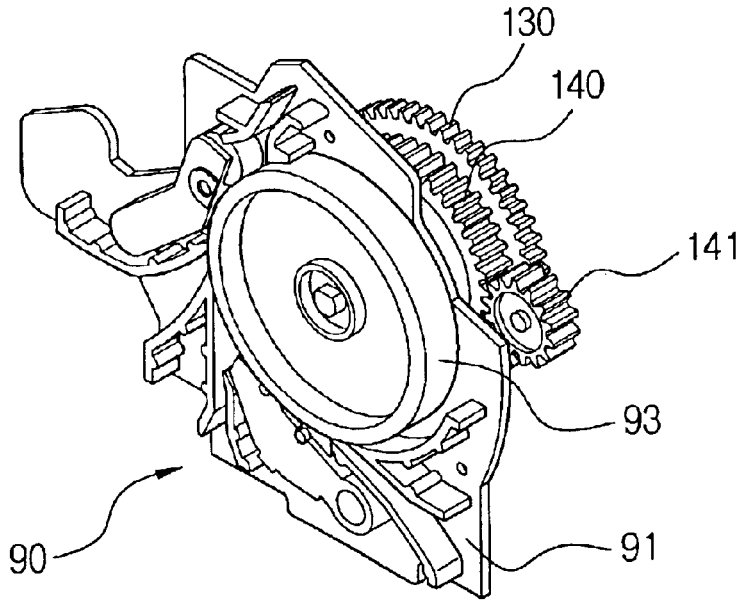
FIG. 4 is a perspective view showing the feeding roller module of FIG. 3.

Referring to FIGS. 3 and 4, the feeding roller module 90 is disposed at a lower portion of the feed frame 60 to convey both the paper fed (picked up) for a single-side printing operation and the paper reversed for the duplex printing operation to the developing unit 35. The feeding roller module 90 has a side bracket 91 disposed on a lower side of the feed frame 60, a feeding roller 93 rotatably disposed on the side bracket 91 and a plurality of paper feeding paths for feeding the paper to the feeding roller 93.

The feeding roller 93 is rotated by a driving source of the printer body 30 to convey the paper toward the developing unit 35. In other words, whether the paper is fed from the paper cassettes 31, 32, 33 or reversed between the feed frame 60 and the back plate 70, the paper is conveyed toward the developing unit 35 by the feed roller 93.

The paper feeding paths include first and second feeding paths P1, P2 for feeding the paper picked-up from the paper cassettes 31, 32 to the feeding roller 93, a third feeding path P3 for guiding the reversed paper passed between the back plate 70 and the feed frame 60 to the feeding roller 93, and a fourth feeding path (a portion of a duplex printing path) P4 for guiding the paper picked up from the removable paper cassette 33 to the feeding roller 93. The respective feeding paths P1~P4 are defined by a plurality of guide members 94~98 formed on the side bracket 91. The fourth feeding path P4 is formed between the third and the second feeding paths P3, P2. Accordingly, all the paper fed into the feeding paths P1~P4 are conveyed toward the developing unit 35 while being in contact with the feeding roller 93.

The feeding roller module 90 further includes a first registration roller unit 110 and a second registration roller unit 120 disposed on the side bracket 91 as shown in FIG. 3. The first registration roller unit 110 is arranged between the first feeding path P1 and the developing unit 35. The first registration roller unit 110 includes a pair of first registration rollers 111, 112 rotated while being in contact with the feeding roller 93, and a first supporting bracket 113 supporting the first registration rollers 111, 112. The first registration rollers 111, 112 are passive-driven and in contact with the feeding roller 93 to convey the fed paper.

The second registration roller unit 120 is disposed between the second feeding path P2 and the fourth feeding path P4. The second registration roller unit 120 includes a pair of second registration rollers 121, 122 each having one of different sizes and a second supporting bracket 123 supporting the second registration rollers 121, 122. The second registration rollers 121, 122 convey the paper fed into the third and the fourth feeding paths P3, P4 toward the developing unit 35 while being disposed in contact with the feeding roller 93 to be rotated.

Further, as shown in FIG. 4, a main gear 130 is disposed on the side bracket 91 to be connected with the feeding roller 93. Here, the main gear 130 receives a power to drive the feeding roller 93. A sub-gear 140, which is coaxially disposed with respect to the main gear 130, is connected to a first power transmission gear 141 transmitting the power to the pickup roller 33*a* that picks up the paper from the removable paper cassette 33.

The sub-gear 140 is connected to a second power transmission gear 65*a* that transmits the power to a reverse conveying roller 65 and the reverse feeding registration roller 75 to convey the paper into a duplex printing path (the third feeding path P4).

In the duplex printing apparatus constructed as above according to this embodiment of the present invention, the paper is selectively picked up and fed from the paper cassettes 31, 32 inside the printer body 30 or from the removable paper cassette 33. The fed paper is guided to the feeding roller 93 through one of the feeding paths P1, P2, P4. The paper is then conveyed toward the developing unit 35. As the paper is passed through the developing unit 35 and the transfer roller 63, the image is developed on the paper, and the paper is passed through the settling unit 40. After passed through the settling unit 40, the paper is passed through the first discharging roller 51. Then, as the paper is passed through the second discharging roller 53 about two-thirds of its length, the first and the second discharging rollers 51, 53 are reverse-rotated. At this time, the paper is reversed when the trailing end of the paper is held by the first discharging roller 51.

The reversed paper is guided by the pivoting lever 83 and fed between the guide frame 81 and the settling unit 40. Continuously, the paper is fed between the back plate 70 and the feed frame 60. Then, the paper is fed into the third feeding path P3 and then to the feeding roller 93. The feeding roller 93 rotates to convey the reversed paper back between the developing unit 35 and the transfer roller 63 so that another image can be formed on a non-printed side of the paper. After completion of the duplex printing operation, the paper is discharged out through the settling unit 30, the first discharging roller 51, and the second discharging roller 53.

As described above, the duplex printing apparatus according to the present invention has a reduced paper conveying path for perform the duplex printing operation, and accordingly, the duplex printing operation is performed within a relatively shorter time.

Also, as the number of parts for the duplex printing function is reduced, a manufacturing cost decreases while a size of the duplex printing apparatus is also reduced.

As a paper reversing path is shortened and becomes simpler, the possibility of occurrence of a paper jam is also reduced. More specifically, by providing a plurality of the feeding paths around the single feeding roller to feed the paper to the developing unit from each of the paper cassettes or the duplex printing path, a space utilization is improved, and an overall cost decreases as the number of parts is reduced.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A duplex printing apparatus having a developing unit forming an image on paper being conveyed, a settling unit fixing the image on the paper, and a discharging roller selectively conveying the paper with the fixed image in an alternate direction, comprising:

a feed frame disposed such that a first side of the feed frame faces the developing unit to guide the paper, which is newly picked up or reversed from the discharge roller, to the developing unit;

a back plate disposed on a second side of the feed frame to guide the paper reversed from the discharging unit for a duplex printing operation;

a duplex unit including a guide frame having a curved surface disposed opposite the settling unit guiding the paper, which is passed through the settling unit and reversed from the discharging unit, between the second side of the feed frame and the back plate; and a feeding roller module comprising a feeding roller disposed on a lower portion of the feed frame to convey both the paper fed for a single-side printing operation and the reversed paper for the duplex printing operation toward the developing unit, and a plurality of paper feeding paths guiding the paper therealong to the feeding roller.

2. The duplex printing apparatus of claim 1, wherein the apparatus comprises a plurality of built-in paper cassettes and an external paper cassette, and the paper feeding paths comprise:

first and second paper feeding paths guiding the paper fed from the built-in paper cassettes to the feeding roller;

a third paper feeding path guiding the paper reversed between the back plate and the feed frame to the feeding roller; and a fourth paper feeding path guiding the paper fed from the external paper cassette to the feeding roller.

3. The duplex printing apparatus of claim 2, wherein the fourth paper feeding path is formed between the first and the second paper feeding paths and the third paper feeding path.

4. A duplex printing apparatus having a developing unit forming an image on paper being conveyed, a settling unit fixing the image on the paper, and a discharging roller selectively conveying the paper with the fixed image in an alternate direction, comprising:

a feed frame disposed such that a first side of the feed frame faces the developing unit to guide the paper, which is newly picked up or reversed from the discharge roller, to the developing unit;

a back plate disposed on a second side of the feed frame to guide the paper reversed from the discharging unit for a duplex printing operation;

a duplex unit guiding the paper, which is passed through the settling unit and reversed from the discharging unit, between the second side of the feed frame and the back plate; and a feeding roller module comprising a feeding roller disposed on a lower portion of the feed frame to convey both the paper fed for a single-side printing operation and the reversed paper for the duplex printing operation toward the developing unit, and a plurality of paper feeding paths guiding the paper therealong to the feeding roller, wherein the apparatus comprises a plurality of built-in paper cassettes and an external paper cassette, and the paper feeding paths comprise:

first and second paper feeding paths guiding the paper fed from the built-in paper cassettes to the feeding roller, a third paper feeding path guiding the paper reversed between the back plate and the feed frame to the feeding roller, and a fourth paper feeding path guiding the paper fed from the external paper cassette to the feeding roller, and wherein the feeding roller module further comprises:

a first registration roller unit disposed to be in contact with the feeding roller to convey the paper fed through the first and the second paper feeding paths, and a second registration roller unit formed between the first and the second paper feeding paths and the fourth paper feeding path to convey the paper fed through the third and the fourth paper feeding paths between the first registration roller unit and the feeding roller.

5. A duplex printing apparatus having a developing unit forming an image on paper being conveyed, a settling unit fixing the image on the paper, and a discharging roller selectively conveying the paper with the fixed image in an alternate direction, comprising:

a feed frame disposed such that a first side of the feed frame faces the developing unit to guide the paper, which is newly picked up or reversed from the discharge roller, to the developing unit;

a back elate disposed on a second side of the feed frame to guide the paper reversed from the discharging unit for a duplex printing operation;

a duplex unit guiding the paper, which is passed through the settling unit and reversed from the discharging unit, between the second side of the feed frame and the back plate; and a feeding roller module comprising a feeding roller disposed on a lower portion of the feed frame to convey both the paper fed for a single-side printing operation and the reversed paper for the duplex printing operation toward the developing unit, and a plurality of paper feeding paths guiding the paper therealong to the feeding roller, wherein the apparatus comprises a plurality of built-in paper cassettes and an external paper cassette, and the paper feeding paths comprise:

first and second paper feeding paths guiding the paper fed from the built-in paper cassettes to the feeding roller, a third paper feeding path guiding the paper reversed between the back plate and the feed frame to the feeding roller, and a fourth paper feeding path guiding the paper fed from the external paper cassette to the feeding roller, and wherein the first, the second, the third and the fourth paper feeding paths are disposed around the feeding roller and formed by a plurality of guiding members that are disposed on a side bracket supporting the feeding roller and the feed frame.

6. A duplex printing apparatus having a developing unit forming an image on paper being conveyed, a settling unit fixing the image on the paper, and a discharging roller selectively conveying the paper with the fixed image in an alternate direction, comprising:

a feed frame disposed such that a first side of the feed frame faces the developing unit to guide the paper, which is newly picked up or reversed from the discharge roller, to the developing unit;

a back plate disposed on a second side of the feed frame to guide the paper reversed from the discharging unit for a duplex printing operation;

a duplex unit guiding the paper, which is passed through the settling unit and reversed from the discharging unit, between the second side of the feed frame and the back plate; and a feeding roller module comprising a feeding roller disposed on a lower portion of the feed frame to convey both the paper fed for a single-side printing operation and the reversed paper for the duplex printing operation toward the developing unit, and a plurality of paper feeding paths guiding the paper therealong to the feeding roller, wherein the apparatus comprises a registration roller and a pickup roller, and the feeding roller module comprises:

a main gear coaxially disposed with respect to the feeding roller to be driven in relation with the feeding roller to be in mesh-engagement with the registration roller and the pickup roller to transmit a power to the registration roller guiding the reversed paper for a duplex driving operation and to the pickup roller picking up the paper from an external paper cassette.

7. A duplex printing apparatus having a printing body with a developing unit recording an image on a sheet, a settling unit fixing the image on the sheet, and a discharging unit receiving a recorded sheet from the settling unit, discharging the recorded sheet outside, and returning the recorded sheet to the developing unit, comprising:

a back plate disposed adjacent to the discharging unit;

a feed frame having a first side forming a printing path with the developing unit, a second side forming a duplex path with the back plate to receive the returned sheet from the discharging unit, and a third side disposed between the first side and the second side to couple the duplex path to the printing path;

a feeding roller module having a feeding roller rotatably disposed on the third side to feed a new sheet introduced onto the feeding roller to the printing path and teed the returned sheet introduced onto the feeding roller from the duplex path to the printing path; and a guide frame having a curved surface disposed opposite the settling unit guiding the returned recording sheet to the duplex path.

8. The duplex printing apparatus of claim 7, wherein the new sheet is introduced onto a first surface of the feeding roller, and the returned sheet is introduced onto a second surface of the feeding roller.

9. The duplex printing apparatus of claim 8, wherein the first surface and the second surface of the feeding roller are disposed on a half portion of a circumferential surface of the feeding roller in a rotational direction of the feeding roller.

10. The duplex printing apparatus of claim 7, wherein the apparatus comprises a cassette and a pickup roller picking up the new sheet to transfer the new sheet to the feeding roller, and wherein the feeding roller receives the new sheet from the pick up roller and guides the new sheet to the developing unit disposed on the printing path.

11. The duplex printing apparatus of claim 7, wherein the apparatus comprises a first built-in cassette, a second built-in cassette, and a removable external cassette all containing the new sheet, and the feeding roller module comprises:

a first guide member disposed between the first built-in cassette and the feeding roller to guide the new sheet to be introduced onto a first portion of the surface of the feeding roller;

a second guide member disposed between the second built-in cassette and the feeding roller to guide the new sheet to be introduced onto a second portion of the surface of the feeding roller;

a third guide member guiding the returned sheet to be introduced onto a third portion of the surface of the feeding roller; and a fourth guide member disposed between the removable external cassette and the feeding roller to guide the new sheet to a fourth portion of the surface of the feeding roller.

12. The duplex printing apparatus of claim 11, wherein the first, second, third, and fourth guide members are disposed around the surface of the feeding roller in a rotational direction of the feeding roller.

13. The duplex printing apparatus of claim 11, wherein the second guide member and the fourth guide member are disposed between the first and third guide members.

14. The duplex printing apparatus of claim 11, wherein the fourth guide member is disposed between the second guide member and the third guide member.

15. The duplex printing apparatus of claim 11, wherein the first guide member and the second guide member comprise a common guide plate guiding the new sheet picked up form one of the first cassette and the second cassette.

16. The duplex printing apparatus of claim 11, wherein the third guide member and the fourth guide member comprise a common guide plate guiding one of the returned sheet and the new sheet picked up from the removable external cassette.

17. The duplex printing apparatus of claim 11, wherein the feeding roller module comprises:

a registration roller disposed between the first guide member and the printing path to be rotated by the feeding roller to feed one of the returned sheet and the new sheet with the feeding roller.

18. The duplex printing apparatus of claim 7, wherein the feed frame comprises a transfer roller disposed on the first side of the feed frame to be rotated by the developing unit to feed the one of the new sheet and the returned sheet to the settling unit.

19. A duplex printing apparatus having a printing body with a developing unit recording an image on a sheet, a settling unit fixing the image on the sheet, and a discharging unit receiving a recorded sheet from the settling unit, discharging the recorded sheet outside, and returning the recorded sheet to the developing unit, comprising:

a back plate disposed adjacent to the discharging unit;

a feed frame having a first side forming a printing path with the developing unit, a second side forming a duplex path with the back plate to receive the returned sheet from the discharging unit, and a third side disposed between the first side and the second side to couple the duplex path to the printing path; and a feeding roller module having a feeding roller rotatably disposed on the third side to feed a new sheet introduced onto the feeding roller to the printing path and feed the returned sheet introduced onto the feeding roller from the duplex path to the printing path, wherein the feeding roller module comprises:

a side bracket having a hole accommodating the feeding roller, a new sheet guide member mounted on the side bracket to guide the new paper to be introduced onto a first surface of the feeding roller to the printing path, and a returned sheet guide member mounted on the side bracket to guide the returned sheet to be introduced onto a second surface of the feeding roller.

20. A duplex printing apparatus having a printing body with a developing unit recording an image on a sheet, a settling unit fixing the image on the sheet, and a discharging unit receiving a recorded sheet from the settling unit, discharging the recorded sheet outside, and returning the recorded sheet to the developing unit, comprising:

a back plate disposed adjacent to the discharging unit;

a feed frame having a first side forming a printing path with the developing unit, a second side forming a duplex path with the back plate to receive the returned sheet from the discharging unit, and a third side disposed between the first side and the second side to couple the duplex path to the printing path; and a feeding roller module having a feeding roller rotatably disposed on the third side to feed a new sheet introduced onto the feeding roller to the printing path and feed the returned sheet introduced onto the feeding roller from the duplex path to the printing path, wherein the feeding roller module comprises:

a side bracket having a hole accommodating the feeding roller; and a registration roller unit disposed adjacent to the hole to face a surface of the feeding roller to feed one of the returned sheet and the new sheet.

21. The duplex printing apparatus of claim 20, wherein the feeding roller module comprises:

a new sheet guide member mounted on the side bracket to communicate with the first portion of the cylindrical surface of the feeding roller to guide the new paper to be introduced onto the first portion of the cylindrical surface of the feeding roller; and a returned sheet guide member mounted on the side bracket to communicate with the second portion of the cylindrical surface of the feeding roller to guide the returned sheet to be introduced onto the second portion of the cylindrical surface of the feeding roller.

22. A duplex printing apparatus having a printing body with a developing unit recording an image on a sheet, a settling unit fixing the image on the sheet, and a discharging unit receiving a recorded sheet from the settling unit, discharging the recorded sheet outside, and returning the recorded sheet to the developing unit, comprising:

a back plate disposed adjacent to the discharging unit;

a feed frame having a first side forming a printing path with the developing unit, a second side forming a duplex path with the back plate to receive the returned sheet from the discharging unit, and a third side disposed between the first side and the second side to couple the duplex path to the printing path; and a feeding roller module having a feeding roller rotatably disposed on the third side to feed a new sheet introduced onto the feeding roller to the printing path and feed the returned sheet introduced onto the feeding roller from the duplex path to the printing path, wherein a registration roller unit comprises:

a registration roller rotatably mounted on the registration roller unit to be in contact with the feeding roller, being rotated by the feeding roller, and feeding the one of the returned sheet and the new sheet with the feeding roller.

23. A duplex printing apparatus having a printing body with a developing unit recording an image on a sheet, a settling unit fixing the image on the sheet, and a discharging unit receiving a recorded sheet from the settling unit, discharging the recorded sheet outside, and returning the recorded sheet to the developing unit, comprising:

a back plate disposed adjacent to the discharging unit;

a feed frame having a first side forming a printing path with the developing unit, a second side forming a duplex path with the back plate to receive the returned sheet from the discharging unit, and a third side disposed between the first side and the second side to couple the duplex path to the printing path; and a feeding roller module having a feeding roller rotatably disposed on the third side to feed a new sheet introduced onto the feeding roller to the printing path and feed the returned sheet introduced onto the feeding roller from the duplex path to the printing path, wherein the feeding roller comprises a cylindrical surface, and the feeding roller module comprises:

a first registration roller disposed to be in contact with a first portion of the cylindrical surface of the feeding roller, being rotated by the feeding roller, and feeding one of the returned sheet and the new sheet with the feeding roller, and a second registration roller unit disposed to be in contact with a second portion of the cylindrical surface of the feeding roller, being rotated by the feeding roller, and feeding the returned sheet with feeding roller.

24. The duplex printing apparatus of claim 23, wherein the first portion of the cylindrical surface and the second portion of the cylindrical surface are disposed on the circumferential surface of the feeding roller in a rotational direction of the feeding roller.

25. A duplex printing apparatus having a printing body with a developing unit recording an image on a sheet, a settling unit fixing the image on the sheet, and a discharging unit receiving a recorded sheet from the settling unit, discharging the recorded sheet outside, and returning the recorded sheet to the developing unit, comprising:

a back plate disposed adjacent to the discharging unit;

a feed frame having a first side forming a printing path with the developing unit, a second side forming a duplex path with the back plate to receive the returned sheet from the discharging unit, and a third side disposed between the first side and the second side to couple the duplex path to the printing path; and a feeding roller module having a feeding roller rotatably disposed on the third side to feed a new sheet introduced onto the feeding roller to the printing path and feed the returned sheet introduced onto the feeding roller from the duplex path to the printing path, wherein the apparatus comprises a first built-in cassette, a second built-in cassette, and a removable external cassette all containing the new sheet, and the feeding roller module comprises:

a first guide member disposed between the first built-in cassette and the feeding roller to guide the new sheet to be introduced onto a first portion of the surface of the feeding roller, a second guide member disposed between the second built-in cassette and the feeding roller to guide the new sheet to be introduced onto a second portion of the surface of the feeding roller, a third guide member guiding the returned sheet to be introduced onto a third portion of the surface of the feeding roller, and a fourth guide member disposed between the removable external cassette and the feeding roller to guide the new sheet to a fourth portion of the surface of the feeding roller, and wherein the feeding roller module comprises a side bracket mounted with the first, second, third, and fourth guide members in a single body.

26. The duplex printing apparatus of claim 25, wherein the side bracket comprises a hole accommodating the feeding roller.

27. The duplex printing apparatus of claim 26, wherein the first, second, third, and fourth guide members form a first path of the new sheet, a second path of the new path, a third path of the returned sheet, and a fourth path of the new sheet, respectively, all communicating with the hole.

28. A duplex printing apparatus having a printing body with a developing unit recording an image on a sheet, a settling unit fixing the image on the sheet, and a discharging unit receiving a recorded sheet from the settling unit, discharging the recorded sheet outside, and returning the recorded sheet to the developing unit, comprising:

a back plate disposed adjacent to the discharging unit;

a feed frame having a first side forming a printing oath with the developing unit, a second side forming a duplex path with the back plate to receive the returned sheet from the discharging unit, and a third side disposed between the first side and the second side to couple the duplex path to the printing path; and a feeding roller module having a feeding roller rotatably disposed on the third side to feed a new sheet introduced onto the feeding roller to the printing path and feed the returned sheet introduced onto the feeding roller from the duplex path to the printing path, wherein the apparatus comprises a first built-in cassette, a second built-in cassette, and a removable external cassette all containing the new sheet, and the feeding roller module comprises:

a first guide member disposed between the first built-in cassette and the feeding roller to guide the new sheet to be introduced onto a first portion of the surface of the feeding roller, a second guide member disposed between the second built-in cassette and the feeding roller to guide the new sheet to be introduced onto a second portion of the surface of the feeding roller, a third guide member guiding the returned sheet to be introduced onto a third portion of the surface of the feeding roller, and a fourth guide member disposed between the removable external cassette and the feeding roller to guide the new sheet to a fourth portion of the surface of the feeding roller, and wherein the feeding roller module comprises:

a registration roller unit disposed between the second guide member and the fourth guide member to feed one of the returned sheet and the new sheet picked up from the removable external cassette with the feeding roller.

29. A duplex printing apparatus having a printing body with a developing unit recording an image on a sheet, a settling unit fixing the image on the sheet, and a discharging unit receiving a recorded sheet from the settling unit, discharging the recorded sheet outside, and returning the recorded sheet to the developing unit, comprising:

a back plate disposed adjacent to the discharging unit;

a feed frame having a first side forming a printing path with the developing unit, a second side forming a duplex path with the back plate to receive the returned sheet from the discharging unit, and a third side disposed between the first side and the second side to couple the duplex path to the printing path; and a feeding roller module having a feeding roller rotatably disposed on the third side to feed a new sheet introduced onto the feeding roller to the printing path and feed the returned sheet introduced onto the feeding roller from the duplex path to the printing path, wherein the apparatus comprises a first built-in cassette, a second built-in cassette, and a removable external cassette all containing the new sheet, and the feeding roller module comprises:

a first guide member disposed between the first built-in cassette and the feeding roller to guide the new sheet to be introduced onto a first portion of the surface of the feeding roller, a second guide member disposed between the second built-in cassette and the feeding roller to guide the new sheet to be introduced onto a second Portion of the surface of the feeding roller, a third guide member guiding the returned sheet to be introduced onto a third portion of the surface of the feeding roller, and a fourth guide member disposed between the removable external cassette and the feeding roller to guide the new sheet to a fourth portion of the surface of the feeding roller, and wherein the apparatus comprises a pickup roller picking up the new sheet from the removable external cassette and a reverse conveying roller disposed on the second side of the feed frame to feed the returned sheet, and the feeding roller module comprises:

a main gear rotating the feeding roller, the pickup roller, and the reverse conveying roller.

30. The duplex printing apparatus of claim 29, wherein the feeding roller module comprises:

a first power transmission gear transmitting a rotational power from the main gear to the pick up roller; and a second power transmission gear transmitting the rotational power from the main gear to the reverse conveying roller.

31. The duplex printing apparatus of claim 29, wherein the back plate comprises:

a reverse feeding registration roller being rotated by the reverse conveying roller to feed the returned sheet from the duplex path to the feeding roller.

32. A duplex printing apparatus having a printing body with a developing unit recording an image on a sheet, a settling unit fixing the image on the sheet, and a discharging unit receiving a recorded sheet from the settling unit, discharging the recorded sheet outside, and returning the recorded sheet to the developing unit, comprising:

a back plate disposed adjacent to the discharging unit;

a feed frame having a first side forming a printing path with the developing unit, a second side forming a duplex path with the back plate to receive the returned sheet from the discharging unit, and a third side disposed between the first side and the second side to couple the duplex path to the printing path; and a feeding roller module having a feeding roller rotatably disposed on the third side to feed a new sheet introduced onto the feeding roller to the printing path and feed the returned sheet introduced onto the feeding roller from the duplex path to the printing path, wherein the apparatus comprises a first built-in cassette, a second built-in cassette, and a removable external cassette all containing the new sheet, and the feeding roller module comprises:

a first guide member disposed between the first built-in cassette and the feeding roller to guide the new sheet to be introduced onto a first portion of the surface of the feeding roller, a second guide member disposed between the second built-in cassette and the feeding roller to guide the new sheet to be introduced onto a second portion of the surface of the feeding roller, a third guide member guiding the returned sheet to be introduced onto a third portion of the surface of the feeding roller, and a fourth guide member disposed between the removable external cassette and the feeding roller to guide the new sheet to a fourth portion of the surface of the feeding roller, and wherein the first, second, third, and fourth guide members guide corresponding ones of the new sheet and the returned sheet in a tangential direction of the feeding roller.

33. A duplex printing apparatus having a printing body with a developing unit recording an image on a sheet, a settling unit fixing the image on the sheet, and a discharging unit receiving a recorded sheet from the settling unit, discharging the recorded sheet outside, and returning the recorded sheet to the developing unit, comprising:

a back plate disposed adjacent to the discharging unit;

a feed frame having a first side forming a printing path with the developing unit, a second side forming a duplex path with the back plate to receive the returned sheet from the discharging unit, and a third side disposed between the first side and the second side to couple the duplex path to the printing path; and a feeding roller module having a feeding roller rotatably disposed on the third side to feed a new sheet introduced onto the feeding roller to the printing path and feed the returned sheet introduced onto the feeding roller from the duplex path to the printing path, wherein the feed frame comprises a fourth side disposed between the first and second sides and opposite to the third side to face the settling unit and form an inlet of the duplex path with the second side and the back plate.

34. The duplex printing apparatus of claim 33, wherein the apparatus comprises a duplex unit disposed adjacent to inlet of the duplex path to guide the returned sheet from the discharge unit to the duplex path.

35. A duplex printing apparatus having a printing body with a developing unit recording an image on a sheet, a settling unit fixing the image on the sheet, and a discharging unit receiving the recorded sheet from the settling unit and discharging the recorded sheet outside or transferring the recorded sheet to the developing unit, comprising:

a back plate disposed adjacent to the discharging unit;

a feed frame disposed in the printing body to form a duplex path with the back plate and a printing path with the developing unit;

a feeding roller rotatably disposed on the feed frame to feed a new sheet introduced onto a first portion of the surface of feeding roller to the printing path and the returned sheet introduced onto a second portion of the surface of the feeding roller from the duplex path to the printing path; and a side bracket having a hole receiving the feeding roller, a first guide member guiding the new sheet to the printing path through the first portion of the surface of the feeding roller, and a second guide member guiding the returned sheet from the duplex path to the printing path through the second portion of the surface of the feeding roller.

36. The duplex printing apparatus of claim 35, wherein the feed frame is disposed between the back plate and the developing unit.

37. The duplex printing apparatus of claim 36, wherein the back plate comprises a reverse feeding registration roller, and the feed frame comprises:

a first side forming the printing path with the developing unit to receive one of the new sheet and the returned sheet;

a second side forming the duplex path with the back plate to receive the returned sheet;

a third side disposed between the first side and the second side and mounted with the feeding roller;

a transfer roller disposed on the first side to be in contact with the developing unit to feed the one of the new sheet and the returned sheet to the settling unit; and a reverse conveying roller disposed on the second side to be in contact with the reverse feeding registration roller of the back plate to feed the returned sheet to the printing path through the feeding roller of the third side.

* * * * *

UNITED STATES PATENT AND TRADEMARK OFFICE

CERTIFICATE OF CORRECTION

PATENT NO. : 6,785,508 B2
DATED : August 31, 2004
INVENTOR(S) : Heung-sup Jeong

It is certified that error appears in the above-identified patent and that said Letters Patent is hereby corrected as shown below:

Column 7,
Line 48, change “elate” to -- plate --.

Column 8,
Line 61, change “teed” to -- feed --.

Column 12,
Line 41, change “oath” to -- path --.

Column 13,
Line 39, change “Portion” to -- portion --.

Signed and Sealed this

Twenty-fifth Day of January, 2005

JON W. DUDAS
*Director of the United States Patent and Trademark Office*